US008708694B2

(12) United States Patent
Delcotto et al.

(10) Patent No.: US 8,708,694 B2
(45) Date of Patent: Apr. 29, 2014

(54) WOODEN WICKS INCLUDING A BOOSTER FOR A CANDLE AND METHOD OF MAKING

(75) Inventors: Melynda Suzanne Delcotto, North Huntingdon, PA (US); Justin Damiani, Youngwood, PA (US)

(73) Assignee: Dream Wick Inc., North Huntingdon, PA (US)

( * ) Notice: Subject to any disclaimer, the term of this patent is extended or adjusted under 35 U.S.C. 154(b) by 1611 days.

(21) Appl. No.: 12/002,819

(22) Filed: Dec. 19, 2007

(65) Prior Publication Data

US 2008/0153046 A1 Jun. 26, 2008

Related U.S. Application Data

(60) Provisional application No. 60/871,264, filed on Dec. 21, 2006.

(51) Int. Cl.
*C11C 5/00* (2006.01)

(52) U.S. Cl.
USPC ..... 431/288; 431/289; 431/291; 431/325

(58) Field of Classification Search
USPC ..... 431/288, 289, 291, 325
See application file for complete search history.

(56) References Cited

U.S. PATENT DOCUMENTS

| | | | | | |
|---|---|---|---|---|---|
| 52,231 | A * | 1/1866 | Walton | 431/325 |
| 59,839 | A * | 11/1866 | Hoard | 431/298 |
| 123,917 | A * | 2/1872 | Ladd | 431/325 |
| 133,973 | A * | 12/1872 | Everett | 44/543 |
| 170,995 | A * | 12/1875 | Daniels | 431/325 |
| 239,855 | A * | 4/1881 | Schneider | 431/325 |
| 252,590 | A * | 1/1882 | Loper | 431/288 |
| 276,602 | A * | 5/1883 | Kirk | 431/267 |
| 383,822 | A * | 5/1888 | Munger | 431/325 |
| 415,231 | A * | 11/1889 | Waters | 44/543 |
| 431,033 | A * | 7/1890 | Chapin | 431/325 |
| 486,966 | A * | 11/1892 | Elsinger | 44/542 |
| 731,033 | A * | 6/1903 | Freeman | 222/324 |
| 747,282 | A * | 12/1903 | Wallgren | 44/543 |
| 2,570,841 | A * | 10/1951 | O'Connor | 102/335 |
| 3,462,235 | A * | 8/1969 | Summers | 431/289 |
| 3,582,251 | A * | 6/1971 | Concannon | 431/126 |
| 3,652,197 | A * | 3/1972 | Tokarz | 431/326 |
| 4,381,914 | A * | 5/1983 | Ferguson | 431/267 |
| 4,386,904 | A * | 6/1983 | Miyahara et al. | 431/126 |
| 5,690,484 | A * | 11/1997 | Leonard et al. | 431/291 |
| 6,068,472 | A * | 5/2000 | Freeman et al. | 431/291 |
| 6,444,156 | B1 * | 9/2002 | Schwarz et al. | 264/405 |
| 6,921,260 | B2 | 7/2005 | Garnys | |
| 7,568,913 | B2 * | 8/2009 | Decker et al. | 431/325 |
| 2004/0009447 | A1 | 1/2004 | Decker | |
| 2005/0037308 | A1 | 2/2005 | Decker | |

FOREIGN PATENT DOCUMENTS

| | | | | |
|---|---|---|---|---|
| FR | 2639356 | A1 * | 5/1990 | C11C 5/00 |
| FR | 2725372 | A1 * | 4/1996 | A61L 9/12 |
| FR | 2726573 | A1 * | 5/1996 | C10L 11/04 |
| FR | 2811676 | A1 * | 1/2002 | C11C 5/00 |

* cited by examiner

*Primary Examiner* — Avinash Savani
(74) *Attorney, Agent, or Firm* — The Webb Law Firm

(57) ABSTRACT

A wooden wick for use in a wax candle comprising a strip of a predetermined wood having each of a first predetermined length, a first predetermined width and a first predetermined thickness. Such wick further includes a booster member having each of a second predetermined length, a second predetermined width and a second predetermined thickness adhered to the strip of wood.

17 Claims, 1 Drawing Sheet

WOODEN WICKS INCLUDING A BOOSTER FOR A CANDLE AND METHOD OF MAKING

CROSS REFERENCE TO RELATED APPLICATION

This patent application is related to and claims priority from U.S. Provisional Patent Application Ser. No. 60/871,264 filed Dec. 21, 2006.

FIELD OF THE INVENTION

The present invention relates, in general, to wicks for candles and, more particularly, this invention relates to a wooden wick equipped with a booster for a candle and to a method of making such wooden wick.

BACKGROUND OF THE INVENTION

Prior to the conception and development of the present invention, as is generally well known in the prior art, candles and wicks which are lit to provide a flame and which melts the wax surrounding such wick have been in existence and commercially available for many years.

These prior art type wicks have normally been produced from a cloth fiber and are embedded into an appropriate portion of the wax, generally in the center, forming the candle. Wicks formed from pieces of wood have also been used, however, these wooden wicks have been formed as a single piece of wood which has a number of distinct disadvantages.

One particular disadvantage of these prior art type wooden wicks is that they are not attractive. Another important disadvantage of the prior art wooden wicks is that they do not come equipped with a booster.

SUMMARY OF THE INVENTION

The present invention provides, in a first aspect, a wooden wick for use in a wax candle. This wooden wick includes a strip of a predetermined wood having each of a first predetermined length, a first predetermined width and a first predetermined thickness. Such wick further includes a booster member having each of a second predetermined length, a second predetermined width and a second predetermined thickness and a means for adhering the booster member to such strip of wood.

In a second aspect, the present invention provides a method of manufacturing a wooden wick for use in a wax candle. The method includes the steps of selecting a type of wood to be formed into a strip of wood to be used in the wooden wick. Thereafter, cutting such wood selected into such strip having each of a first predetermined length, a first predetermined width and a first predetermined thickness.

The method further includes forming a booster member having each of a second predetermined length, a second predetermined width and a second predetermined thickness and adhering such booster member to the strip of wood.

OBJECTS OF THE INVENTION

It is, therefore, one of the primary objects of the present invention to provide an improved wooden wick for use in a wax type candle.

Another object of the present invention is to provide a method of producing such wooden wick.

Still another object of the present invention is to provide a wooden wick for use in a wax candle which is relatively inexpensive to produce.

Yet another object of the present invention is to provide a wooden wick for a wax candle which has enhanced visual appeal.

An additional object of the present invention is to provide a method of producing a wooden wick for a wax candle which will exhibit enhanced visual appeal.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
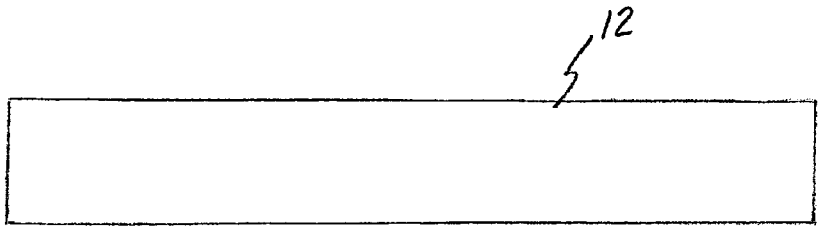
FIG. 1 is a plan view of the wood portion of the wooden wick according to a presently preferred embodiment of the invention.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 2:
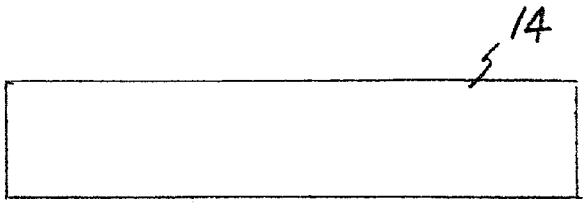
FIG. 2 is a plan view of the booster portion for use with the wooden wick illustrated in FIG. 1 according to the presently preferred embodiment of the invention.
Figure 3:
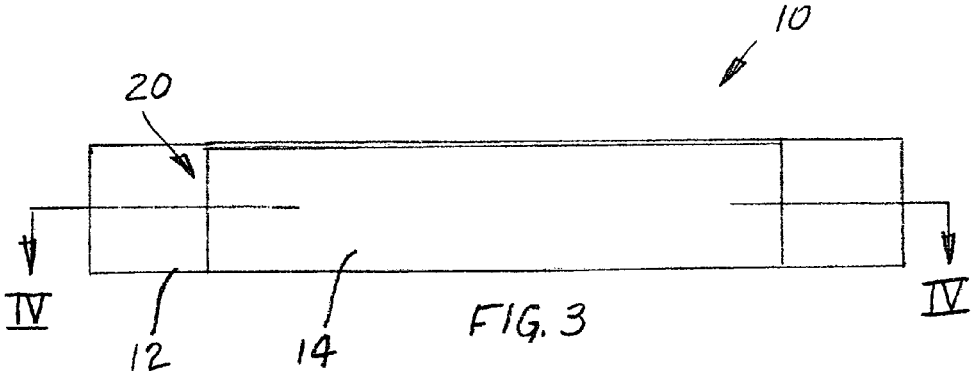
FIG. 3 is a plan view of the wooden wick illustrating the wooden portion illustrated in FIG. 1 adhered to the booster portion illustrated in FIG. 2 according to the presently preferred embodiment of the invention.
Figure 4:
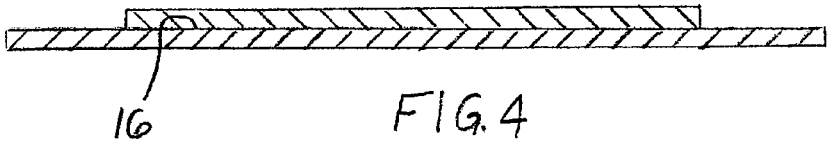
FIG. 4 is a cross sectional view taken along the lines iv-iv of FIG. 3.

Reference is now made, more particularly, to FIGS. 1-4. Illustrated therein is a wooden wick, generally designated 10, for use in a wax candle (not shown). The wooden wick 10 includes a strip of a predetermined wood 12 having each of a first predetermined length, a first predetermined width and a first predetermined thickness. In the presently preferred embodiment of the invention, the first predetermined length of such strip of wood 12 will generally be between about 4.375 and about 5.125 inches. In this embodiment, the first predetermined width of the strip of wood 12 will generally be between about 0.70 inch and about 0.80 inch.

Further, the wooden wick, according to the present invention, includes a booster member 14 having each of a second predetermined length, a second predetermined width and a second predetermined thickness and a means, generally designated 20, for adhering the booster member 14 to such strip of wood 12. Such means 20 is preferably an adhesive layer 16.

In the presently preferred embodiment of the invention, the second predetermined length of such booster member 14 will generally be between about 3.45 and about 3.55 inches and the second predetermined width of the booster member 14 will generally be between about 0.70 inch and about 0.80 inch. Further, in this embodiment such first and second predetermined thickness will be substantially identical.

The wooden wick 10 further includes a coloring agent to stain the wooden strip 12 for enhancing a visual appearance thereof. Preferably, such coloring agent is a vegetable type coloring agent.

The present invention provides, in a second aspect a method of manufacturing a wooden wick for use in a wax candle. The method includes selecting a type of wood to be formed into a strip of wood to be used in such wooden wick. Then, cutting the wood selected into such strip having each of a first predetermined length, a first predetermined width and a first predetermined thickness.

Additionally, the method includes forming a booster member having each of a second predetermined length, a second predetermined width and a second predetermined thickness and then adhering such booster member to such strip of wood. Preferably, an adhesive is selected for adhering the booster member to such strip of wood.

In the preferred embodiment, such method further includes an addition step of ensuring that the strip of wood is clean before such strip of wood is adhered to the booster member and further that such strip of wood is treated with a liquid wax and that the wooden wick is cured, preferably by baking, prior to use in such candle. It is further preferred that the booster member be soaked in a soy oil prior to adhering it to said strip of wood. Thereafter said booster member is coated with a wax type material.

Additionally, the method includes an additional step of drying the wooden wick for a predetermined time generally for about 48.0 hours, prior to use in such candle.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

We claim:

1. A wooden wick embedded in a wax candle, said wooden wick and said wax candle comprising: (a) a strip of a predetermined wood having each of a first predetermined length, a first predetermined width and a first predetermined thickness; (b) a wooden booster member having each of a second predetermined length, a second predetermined width and a second predetermined thickness, said first predetermined width is greater than said second predetermined width; and (c) means for adhering said booster member to said strip of wood, wherein said strip of wood is treated with a liquid wax; (d) said wax candle in direct contact with said wooden wick.

2. A wooden wick, according to claim 1, wherein said first predetermined length of said strip of wood is generally between 4.375 and 5.125 inches.

3. A wooden wick, according to claim 1, wherein said first predetermined width of said strip of wood is generally between 0.70 inch and 0.80 inch.

4. A wooden wick, according to claim 1, wherein said second predetermined length of said booster member is generally between 3.45 and 3.55 inches.

5. A wooden wick, according to claim 1, wherein said second predetermined width of said booster member is generally between 0.70 inch and 0.80 inch.

6. A wooden wick, according to claim 1, wherein said first and said second predetermined thickness are substantially identical.

7. A wooden wick, according to claim 1, wherein said means for adhering said booster member to said strip of wood is an adhesive.

8. A wooden wick, according to claim 1, wherein said wooden wick further includes coloring agent to stain said wood for enhancing a visual appearance thereof.

9. A wooden wick, according to claim 8, wherein said coloring agent is a vegetable coloring agent.

10. A method of manufacturing a wooden wick embedded in a wax candle, said method comprising the steps of:

(a) selecting a type of wood to be formed into a strip of wood to be used in said wooden wick;

(b) cutting said wood selected in step (a) into said strip having each of a first predetermined length, a first predetermined width and a first predetermined thickness;

(c) forming a wooden booster member having each of a second predetermined length, a second predetermined width and a second predetermined thickness, said first predetermined width is greater than said second predetermined width;

(d) adhering said booster member to said strip of wood;

(e) soaking said wooden booster member in a soy oil prior to assembly;

(f) embedding said wooden wick in said candle such that both are in direct with one another.

11. A method of manufacturing a wooden wick, according to claim 10, wherein step (d) includes selecting a suitable adhesive for adhering said booster member to said strip of wood.

12. A method of manufacturing a wooden wick, according to claim 10, wherein said method further includes an addition step of ensuring said strip of wood is clean before strip of wood is adhered to said booster member.

13. A method of manufacturing a wooden wick, according to claim 10, wherein said method further includes an additional step of treating said strip of wood with a liquid wax.

14. A method of manufacturing a wooden wick, according to claim 10, wherein said method further includes an additional step of curing said wooden wick prior to use in such candle.

15. A method of manufacturing a wooden wick, according to claim 14, wherein said additional step of curing said wooden wick prior to use in such candle includes a step of baking.

16. A method of manufacturing a wooden wick, according to claim 10, wherein said method further includes an additional step of drying said wooden wick for a predetermined time prior to use in such candle.

17. A method of manufacturing a wooden wick, according to claim 16, wherein said predetermined time is generally about 48.0 hours.

* * * * *

UNITED STATES PATENT AND TRADEMARK OFFICE

CERTIFICATE OF CORRECTION

PATENT NO. : 8,708,694 B2
APPLICATION NO. : 12/002819
DATED : April 29, 2014
INVENTOR(S) : Melynda S. Delcotto et al.

It is certified that error appears in the above-identified patent and that said Letters Patent is hereby corrected as shown below:

In the Claims

Column 4, Lines 29-30, Claim 10, after "soy oil" delete "prior to assembly"

Column 4, Line 32, Claim 10, after "direct" insert -- contact --

Signed and Sealed this
Ninth Day of September, 2014

Michelle K. Lee

Michelle K. Lee
*Deputy Director of the United States Patent and Trademark Office*